US008894041B2

(12) United States Patent
Sachs et al.

(10) Patent No.: US 8,894,041 B2
(45) Date of Patent: Nov. 25, 2014

(54) FENCE DROPPERS, FENCE CLIPS AND FENCING SYSTEMS

(75) Inventors: Nicholas Sachs, Brisbane (AU); Wei Wang, Brisbane (AU); David John Elms, Brisbane (AU)

(73) Assignee: Persimmon Nominees Pty Ltd, Queensland (AU)

( * ) Notice: Subject to any disclaimer, the term of this patent is extended or adjusted under 35 U.S.C. 154(b) by 15 days.

(21) Appl. No.: 13/401,862

(22) Filed: Feb. 22, 2012

(65) Prior Publication Data

US 2012/0256147 A1 Oct. 11, 2012

(30) Foreign Application Priority Data

Feb. 22, 2011 (AU) ..... 2011200743

(51) Int. Cl.
*E04H 17/02* (2006.01)
*E04H 17/12* (2006.01)

(52) U.S. Cl.
CPC ..... *E04H 17/12* (2013.01)
USPC ..... 256/57

(58) Field of Classification Search
USPC ..... 256/47, 48, 57, 32, DIG. 5, DIG. 3; 47/46, 47
See application file for complete search history.

(56) References Cited

U.S. PATENT DOCUMENTS 1,023,880 A * 4/1912 Rubeck ..... 256/53
1,050,589 A * 1/1913 Young ..... 256/48
1,179,862 A * 4/1916 Parrish ..... 256/48
1,464,326 A * 8/1923 Lindstrom et al. ..... 256/48
1,510,686 A * 10/1924 Knopke ..... 256/57
1,639,195 A * 8/1927 Meaker et al. ..... 256/57
1,712,752 A * 5/1929 Dandliker ..... 256/57
1,761,452 A * 6/1930 Paque ..... 256/57
1,791,692 A * 2/1931 Swenson ..... 256/57
1,814,228 A * 7/1931 Peters ..... 256/57
1,848,515 A * 3/1932 Davidson ..... 256/57

(Continued)

FOREIGN PATENT DOCUMENTS

AU 556072 10/1986
JP 02169179 A * 6/1990

OTHER PUBLICATIONS

New Zealand Examination Report for Application No. 598358, dated May 25, 2012, "Of Record" as noted in Mar. 28, 2013 Office communication.
Nov. 9, 1973, Abstract and drawing for NZ 161830 to Hall.

*Primary Examiner* — Michael P Ferguson
*Assistant Examiner* — Daniel Wiley
(74) *Attorney, Agent, or Firm* — Neifeld IP Law, PC

(57) ABSTRACT

A fencing system comprises a fence dropper and a fence clip that couples a fence wire to the fence dropper. The fence dropper comprises an elongate body having a cross-section comprising a pair of spaced apart walls coupled by a web. At least one slot is provided in each wall on a first side of the web for capturing the fence wire. A ratio of a slot breaking mass to a cross sectional area of the fence dropper is substantially optimized. The fence clip comprises an elongate wire bent into an asymmetric shape and comprises a central portion which abuts a second side of the fence dropper and an arm extending from each end of the central portion. A hook portion of each arm captures the fence wire and a lever or lever portion of the hook portions extends the length of the fence clip to facilitate installation.

30 Claims, 10 Drawing Sheets

(56) References Cited

U.S. PATENT DOCUMENTS

| | | | | | |
|---|---|---|---|---|---|
| 1,852,910 | A | * | 4/1932 | Williams et al. | 256/48 |
| 1,859,688 | A | * | 5/1932 | Wilson | 256/57 |
| 1,859,695 | A | * | 5/1932 | Czemba | 256/57 |
| 1,868,557 | A | * | 7/1932 | Williams | 256/57 |
| 1,890,338 | A | * | 12/1932 | Paque | 256/57 |
| 1,894,783 | A | * | 1/1933 | Ochiltree | 256/57 |
| 1,959,230 | A | * | 5/1934 | Christoffersen | 256/57 |
| 1,971,047 | A | * | 8/1934 | Moritz | 256/57 |
| 2,046,250 | A | * | 6/1936 | Czemba | 256/57 |
| 2,150,291 | A | * | 3/1939 | Paque | 52/153 |
| 2,227,553 | A | * | 1/1941 | Paque | 52/153 |
| 2,618,685 | A | * | 11/1952 | Lewis | 174/161 F |
| 3,169,750 | A | * | 2/1965 | Weed | 256/57 |
| 3,246,880 | A | * | 4/1966 | Weed | 256/57 |
| 3,394,922 | A | * | 7/1968 | Bradbury | 256/57 |
| 3,977,653 | A | | 8/1976 | Fingerson | |
| 4,270,581 | A | * | 6/1981 | Claxton et al. | 140/57 |
| 4,383,396 | A | * | 5/1983 | Waugh | 52/40 |
| 4,510,721 | A | * | 4/1985 | Murphy | 52/40 |
| 4,643,400 | A | * | 2/1987 | Porat | 256/52 |
| 4,917,154 | A | | 4/1990 | Roberson | |
| 5,518,044 | A | | 5/1996 | Ferguson | |
| 5,649,572 | A | | 7/1997 | Lile | |
| 6,044,872 | A | | 4/2000 | Stephans | |
| 6,454,244 | B1 | * | 9/2002 | Coulson | 256/1 |
| 6,499,514 | B1 | | 12/2002 | Hodge | |
| 6,932,327 | B2 | * | 8/2005 | Alberson et al. | 256/13.1 |
| 7,520,491 | B1 | | 4/2009 | Post | |
| 2001/0040235 | A1 | * | 11/2001 | Dwyer et al. | 256/47 |

* cited by examiner

FENCE DROPPERS, FENCE CLIPS AND FENCING SYSTEMS

FIELD OF THE INVENTION

Embodiments of the present invention relate to fence droppers, fence clips for use with fence droppers and fencing systems comprising fence droppers and fence clips.

BACKGROUND TO THE INVENTION

One type of fence typically used in rural areas is a wire fence comprising a plurality of spaced apart, substantially parallel wires supported periodically along the fence line by fence posts. In addition to fence posts, or sometimes as an alternative, fence droppers (also known as fence stays or fence spacers) are used periodically to maintain the wires in a spaced relationship. Fence droppers are particularly useful in maintaining the spaced relationship between the wires after an impact on the fence, for example from a large animal, by transferring loads from one or two wires to the whole fence. Fence droppers also help maintain the integrity of the fence as the fence ages because the wires tend to sag over time if they are not re-tensioned. Wire fences are often electrified to keep animals away from the fence and to deter intruders to the fenced property.

Most known fence droppers are elongate and span the full vertical height of the fence occupied by the wires or a large proportion of the vertical height of the fence. Fence droppers may or may not be inserted into the ground and can be made from a range of materials, such as metals and plastics. A wide range of designs are known for fence droppers and for attaching the droppers to the wires. Each design typically possesses a number of advantages and disadvantages relating to one or more of ease and cost of production, amount of materials consumed, ease of packaging, transportation and/or installation, durability and/or ease of maintenance. It has proven difficult to maximise the advantages of such fence droppers whilst minimising the drawbacks.

One common design of fence dropper and means of attaching the wires thereto comprises a plastic fence dropper, optionally having a plurality of protrusions or slots for accommodating the wires, and a metal clip which secures the wires in place against the dropper. There are a large number of variations of this arrangement, but many can be difficult to install. Installation typically requires both hands and a significant amount of force. Installation also often requires the aid of a common tool, such as a screwdriver, or the aid of a specialist tool, because the clip is deformed significantly from its original shape either temporarily or permanently to secures the wire to the dropper, hence the requirement of significant force to install. These drawbacks represent a significant issue when long distances of fence must be installed or maintained and repetitive strain injury (RSI) is a common consequence. Furthermore, whilst difficult to install, the wires can often be dislodged from the dropper relatively easily in many of these designs.

Examples of fence droppers and clip arrangements requiring a specialist tool for installation are disclosed in the following patents: U.S. Pat. No. 4,917,154, U.S. Pat. No. 5,518,044, U.S. Pat. No. 5,649,572, U.S. Pat. No. 6,044,872, U.S. Pat. No. 6,499,514 and U.S. Pat. No. 7,520,491. U.S. Pat. No. 3,977,653 discloses a fence post and fence clip that require a pair of pliers or a nail for installation. These patents also disclose a range of clip shapes and fence dropper shapes and a further example is disclosed in U.S. Pat. No. 1,761,452.

Nonetheless, in one particularly successful version, a plastic fence dropper comprises a hollow, box-shaped cross section and a plurality of shallow slots for holding fence wires. A complimentarily shaped symmetrical metal clip has a hook at each end. The clip fits around three sides of the box-shaped cross section and the hooks capture a wire either side of the fence dropper to secure the wire in a pair of slots in the fence dropper. A separate clip is used to secure each wire to the fence dropper. This particular design is cheap to produce and easy to ship and consequently enjoys a good market share. However, the fence dropper is made from low tensile poly ethylene (PE) and therefore is low in strength. This leads to a shorter life and therefore increased frequency of replacement. The low strength is evidenced by other fence droppers offered by the same manufacturer, which utilise an insert in the form of a galvanised metal post within the hollow plastic fence dropper. In addition to the additional cost and assembly of such fence droppers, the metal insert is not resilient and if the fence dropper is deflected beyond the elastic limit of the insert, the fence dropper will acquire a permanently deflected shape. The box-shaped cross section is also quite large, which results in a high delivery cost per unit and a high material consumption. The difficulty of installation mentioned above is also not adequately addressed.

There is a need to address or at least ameliorate one or more of the aforementioned problems of the prior art or to provide a commercially useful alternative.

SUMMARY OF THE INVENTION

Embodiments of the present invention comprise an improved fence dropper, an improved fence clip and a fencing system comprising the fence dropper and the fence clip for holding wires of a wire fence.

According to one aspect, although not necessarily the broadest aspect, the invention resides in a fence dropper comprising:

an elongate body having a pair of spaced apart walls coupled by a web therebetween; and at least one slot in each of the walls on a first side of the web;

wherein a ratio of a slot breaking mass to a cross sectional area of the fence dropper is substantially optimised.

Suitably, a cross section of the fence dropper is substantially H-shaped or substantially A-shaped.

Preferably, the walls are of a greater thickness on the first side of the web than a thickness of the walls on a second side of the web.

Preferably, the spaced apart walls are substantially parallel and the web is substantially perpendicular to the walls.

Alternatively, the walls are angled with respect to each other at an angle of greater than 0° and up to about 60°. Additionally, or alternatively, the web is at an angle of greater than 90° and up to about 120° with respect to one or both of the walls.

Suitably, one or more ends of the walls on the second side of the web are rounded where contact is made with a fence clip used in conjunction with the fence dropper.

Suitably, the slots have a dovetail shape, a wedge shape or are substantially C-shaped. Preferably, a size of the slot increases from an opening of the slot to a rear wall of the slot.

Preferably, each wall comprises a plurality of spaced apart slots along a length of the elongate body.

Preferably, each slot comprises upper and lower lips wherein at least one lip of the opening is flared outwardly.

Suitably, at least some of the slots are equally and/or unequally spaced along the length of the elongate body.

Preferably, each slot in one of the walls is horizontally aligned with a respective slot in the other wall.

Suitably, the web comprises one or more apertures therethrough.

Preferably, the fence dropper is moulded or otherwise formed from plastics material, such as high density poly ethylene (HDPE), acrylonitrile styrene acrylate (ASA) or poly vinyl chloride (PVC) including an ultraviolet (UV) stabilising additive.

The fence dropper may further comprise at least one bead at an interface between one of the walls and the web to minimise stress concentration. A radius of the bead on the first side of the web may be the same as or different to the radius of the bead on a second side of the web.

The packing efficiency of multiple fence droppers is at least 60%.

According to another aspect, although not necessarily the broadest aspect, the invention resides in a fence dropper comprising:

an elongate body having a substantially H-shaped cross section comprising a pair of spaced apart opposing walls coupled by a web therebetween; and at least one slot in each of the walls on a first side of the web.

According to a further aspect, although not necessarily the broadest aspect, the invention resides in a fence dropper comprising:

an elongate body having a substantially A-shaped cross section comprising a pair of spaced apart opposing walls coupled by a web therebetween; and at least one slot in each of the walls on a first side of the web.

According to another aspect, although not necessarily the broadest aspect, the invention resides in a fence clip comprising:

an elongate wire bent into an asymmetric shape having a central portion to abut a fence dropper and an arm extending from each end of the central portion;

a hook portion extending from an end of each arm to capture a fence wire; and at least one lever or lever portion extending from one of the hook portions in a direction away from the central portion which extends the length of the fence clip at least along a positive x-axis.

Preferably, the central portion of the elongate wire is bent about a substantially central point at an angle of between about 160° and less than 180°.

Preferably, the arms are in the same plane as the central portion.

Suitably, the arms are at an angle of between about 100° and about 150° to the adjacent central portion.

Preferably, the hook portions are in the same plane as the arm from which the hook extends.

Suitably, the lever is in the same plane as the hook portion from which the lever or lever portion extends.

Preferably, the lever or lever portion comprises a looped end, which is preferably in a different plane to the plane of the lever. Suitably, the plane of the looped end is at an angle of between about 30° and about 60° to the plane of the lever or lever portion.

Suitably, the fence clip may comprise a first lever portion extending from one of the hook portions and a second lever portion extending from the first lever portion at an angle to the first lever portion. The second lever portion may be of extended length.

The fence clip may further comprising a leg extending from the second lever portion.

The looped end, first lever portion, second lever portion and/or leg facilitate the coupling of the fence wire to the fence dropper in a one-handed operation.

Preferably, one or more of the looped end, first lever portion, second lever portion and/or leg increase the length of the fence clip along a negative y-axis.

Preferably, a location of a bending point between the first lever portion and the second lever portion aids reduction in a force required to install the fence clip.

The fence clip may be made from steel wire, stainless steel wire, high tensile spring steel wire, galvanised steel wire, passivated steel wire, Suitably, the tensile strength of the fence clip is between 400 Mpa and 2100 Mpa.

According to a further aspect, although not necessarily the broadest aspect, the invention resides in a fencing system comprising:

a fence dropper comprising:

an elongate body having a pair of spaced apart walls coupled by a web therebetween; and at least one slot in each of the walls on a first side of the web for capturing a fence wire;

wherein a ratio of a slot breaking mass to a cross sectional area of the fence dropper is substantially optimised; and a fence clip comprising:

an elongate wire bent into an asymmetric shape having a central portion to abut a second side of the fence dropper and an arm extending from each end of the central portion;

a hook portion extending from an end of each arm to capture the fence wire; and at least one lever or lever portion extending from one of the hook portions in a direction away from the central portion which extends the length of the fence clip at least along a positive x-axis.

Further features of the invention will become apparent from the following detailed description of embodiments of the invention.

BRIEF DESCRIPTION OF THE DRAWINGS

Embodiments of the present invention will now be described in detail with reference to the accompanying drawings which are given by way of example only and wherein like reference numerals refer to like elements. In the drawings.

DETAILED DESCRIPTION OF EMBODIMENTS OF THE INVENTION

Embodiments of the present invention comprise an improved fence dropper, an improved fence clip and a fencing system comprising the fence dropper and the fence clip for holding wires of a wire fence. FIGS. 1, 2 and 3-6 show an embodiment of the fence dropper holding a fence wire and secured in place with an embodiment of the clip thus illustrating the fencing system. FIGS. 2A-2C and 7 show embodiments of the fence dropper without the fence clip and FIGS. 8-13 show various embodiments of the fence clip.

Figure 1:
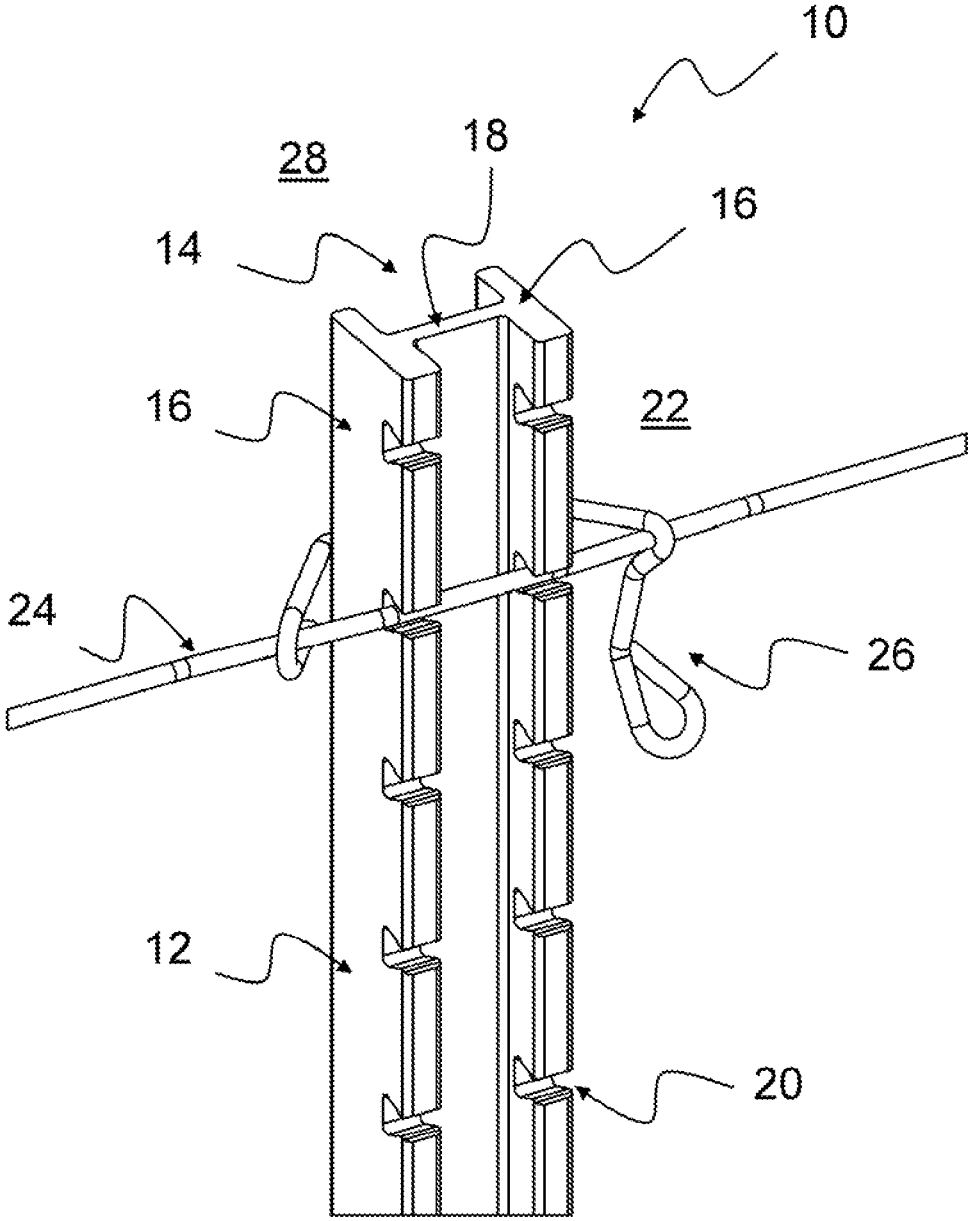
FIG. 1 is a front left perspective view of a fence dropper and a fence clip according to embodiments of the present invention.

With reference to FIG. 1, a fence dropper 10 according to one aspect of the present invention comprises an elongate body 12 having a substantially H-shaped cross-section 14. The H-shaped cross-section comprises a pair of spaced apart walls 16 coupled by a web 18. Walls 16 comprise at least one slot 20 in each of the walls on a first side 22 of the web to capture a wire 24 of the wire fence. Each slot 20 in one of the walls 16 is aligned with a respective slot 20 in the other wall 16 such that the wire 24 is captured in a pair of aligned slots 20 and the wire is substantially horizontal.

In the embodiment shown in FIG. 1, each wall 16 comprises a plurality of spaced apart slots 20 along a length of the elongate body 12 to capture a plurality of fence wires. However, for clarity only one fence wire 24 is shown in FIG. 1. In the embodiment shown in FIG. 1, the slots are equally spaced along the length of the elongate body 12. However, in other embodiments the spacing may be uneven such that the slots are unequally spaced depending on the type of fence required. Some embodiments can include some equally spaced slots and some unequally spaced slots.

FIG. 1 also shows an embodiment of a fence clip 26 according to another aspect of the present invention, which can be used in conjunction with the fence dropper 10. The fence clip 26 hooks onto the fence wire 24 on one side of the fence dropper 10, such as the left side of the fence dropper. The fence clip 26 passes behind the fence dropper on a second side 28 of the web 18, i.e. a side opposite the slots 20. Fence clip 26 hooks onto the fence wire 24 on the other side, i.e. the right side, of the fence dropper 10 to securely retain the wire in the slots 20. The fence clip 26 will be described in further detail hereinafter.

Figure 2:
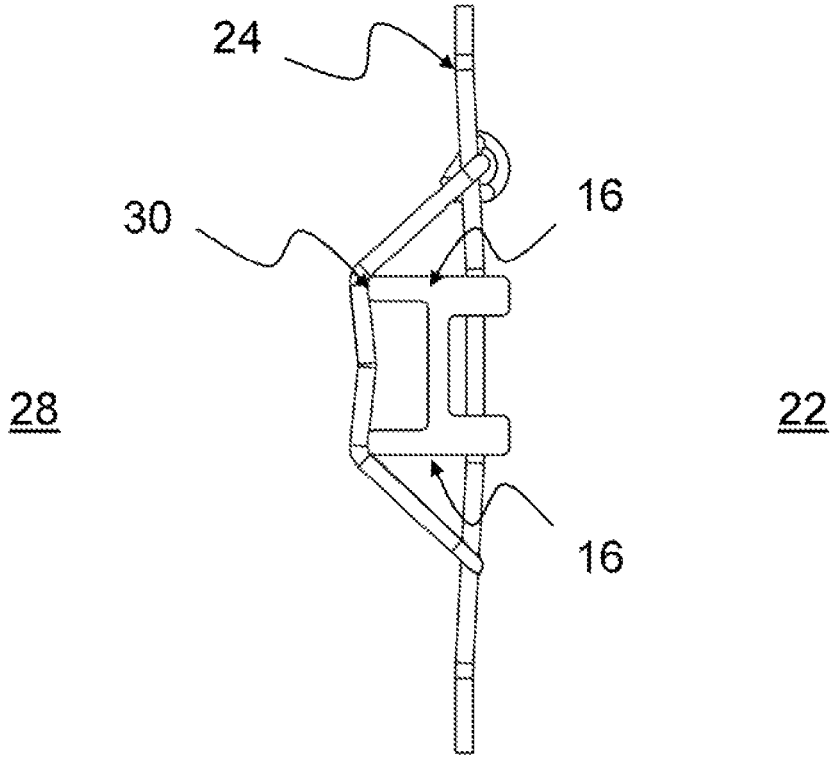
FIG. 2 is a plan view of the fence dropper and fence clip shown in FIG. 1.
Figure 2A:
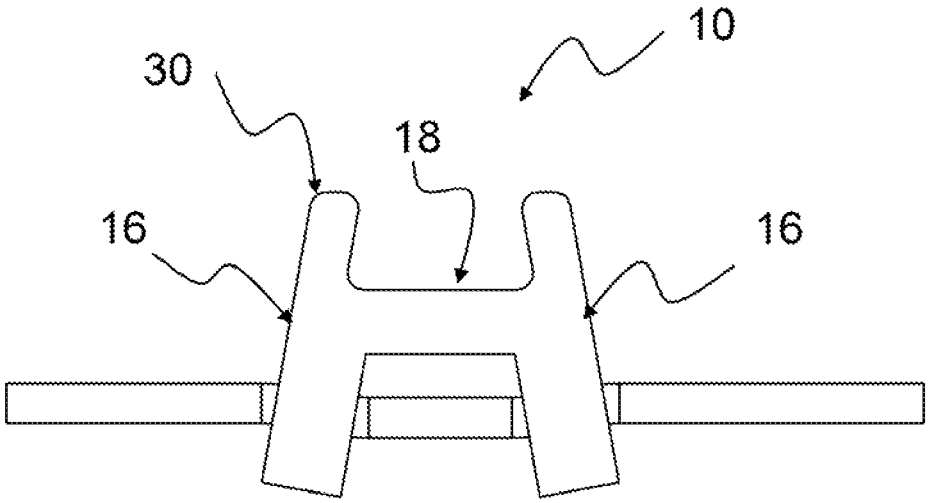
FIG. 2A is a plan view of another embodiment of the fence dropper.
Figure 2B:
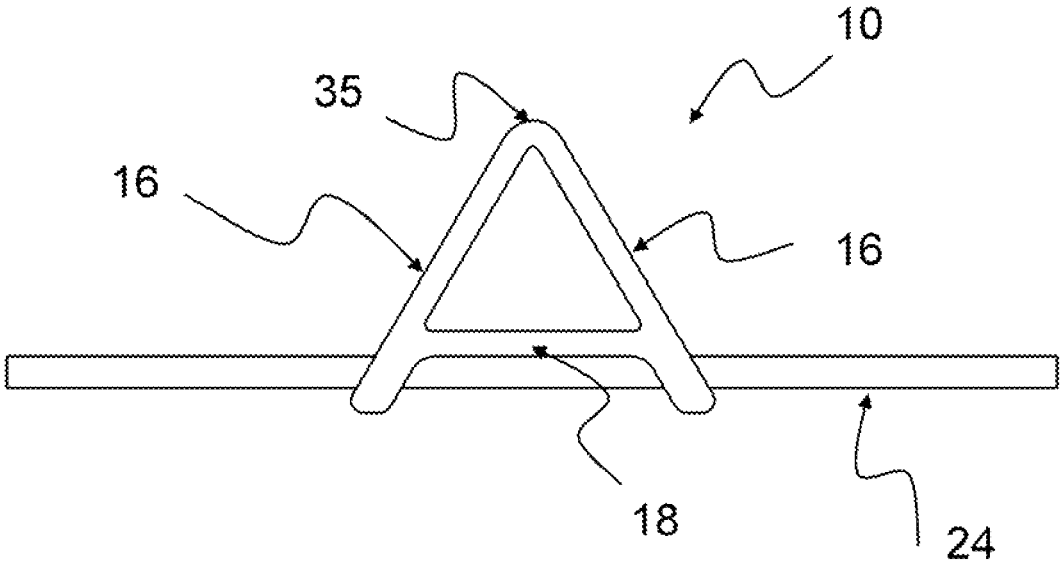
FIG. 2B is a plan view of an alternative embodiment of the fence dropper.

Referring to FIG. 2, the substantially H-shaped cross section 14 of the fence dropper 10 provides the fence dropper with high compressive strength. Walls 16 are of a greater thickness on the first side 22 of the web 18 than a thickness of the walls on the second side 28 of the web. The increased thickness of the walls 16 on the first side 22 compared with the second side 28 helps to maintain the strength of the fence dropper 10. The increased thickness is provided because the first side 22 of the walls 16 holds the fence wires 24 and will be subject to greater forces than the second side 28. The increased thickness also compensates for the absence of material which creates slots 20 in the walls 16 on the first side 22. Ends 30 of the walls 16 on the second side 28 of the web 18 are rounded where contact is made with the fence clip 26, as shown in FIG. 2.

In the embodiment shown in FIG. 2, the spaced apart walls 16 are substantially parallel and the web 18 is substantially perpendicular to the walls. However, with reference to FIGS. 2A and 2B, strict adherence to the parallelism of the walls 16 and the perpendicular nature of the web 18 thereto is not essential. For example, in some embodiments, walls 16 can be angled with respect to each other and/or the web 18 can be at an angle away from 90° with respect to one or both of the walls 16. In the example shown in FIG. 2A, walls 16 are inclined at an angle of 30°, but other angles in the range greater than 0° and up to about 60° can be employed. In the example shown in FIG. 2A, web 18 is at an angle of about 105°, but other angles greater than 90° and up to about 120° can be employed in such embodiments. In the example shown in FIG. 2B, walls 16 are inclined at an angle of 60° to web 18. The ends of angled walls 16 on the second side 28 of the web 18 meet to form a rounded apex 35, such that a cross section of the fence dropper 10 is substantially A-shaped.

Irrespective of whether the fence dropper 10 comprises a substantially H-shaped cross section, a substantially A-shaped cross section or a cross section having walls 16 at intermediate angles and/or where web 18 is not substantially perpendicular to walls 16, a ratio of a slot breaking mass to a cross sectional area of the fence dropper 10 is substantially optimised. The slot breaking mass is the mass required to break the slot 20 in the fence dropper. Such optimisation maximises the strength of the fence dropper 10 whilst minimising the amount of material required for the fence dropper. With reference to FIG. 20, Table 1 below shows experimental data for a fence dropper having a substantially H-shaped cross section, having an overall cross section of 25 mm×20 mm and formed from HDPE. The fence dropper has a thickness T1 of walls 16 on the first side 22 of web 18, a thickness T2 of walls 16 on the second side 28 of web 18 and a thickness T3 of web 18. In testing fence wire of diameter 2.5 mm was used.

The experimental data in Table 1 shows that embodiment no. 5 in which T1=5 mm, T2=3.5 mm and T3=3 mm provides a fence dropper having a substantially H-shaped cross section in which the ratio of the slot breaking force to a cross sectional area is substantially optimised. However, the skilled addressee will recognise that the present invention is not limited to these specific measurements. For example, in one embodiment of the fence dropper having a substantially H-shaped cross section, T1 is increased to 5.5 mm to compensate for wires gauges less than 2.5 mm. Smaller gauge wire applies a greater pressure to the fence dropper for the same load due to their smaller area. As described herein, variations from the substantially H-shaped cross section for the fence dropper are within the scope of the present invention and various materials can be used for the fence dropper, which can lead to variations in dimensions.

TABLE 1

| No | T1 (mm) | T2 (mm) | T3 (mm) | Cross section area ($mm^2$) | Breaking mass without clip in kg | Optimum rate: Breaking mass/cross section area |
|---|---|---|---|---|---|---|
| 1 | 4 | 4 | 4 | 242.4 | 150.8 | 0.622 |
| 2 | 5 | 4 | 4 | 259.4 | 168.2 | 0.648 |
| 3 | 6 | 4 | 4 | 276.4 | 179.8 | 0.65 |

TABLE 1-continued

| No | T1 (mm) | T2 (mm) | T3 (mm) | Cross section area ($mm^2$) | Breaking mass without clip in kg | Optimum rate: Breaking mass/cross section area |
|---|---|---|---|---|---|---|
| 4 | 6 | 3 | 3 | 237.3 | 165.3 | 0.697 |
| 5 | 5 | 3.5 | 3 | 229.6 | 163.8 | 0.713 |
| 6 | 5 | 4 | 4 | 257.4 | 174.0 | 0.675 |

It will be appreciated that the slot breaking mass can be expressed as a slot breaking force merely by multiplying the slot breaking mass values by g (9.80665 $ms^{-2}$). Consequently an optimum ratio of slot breaking force to cross sectional area of the fence dropper can be calculated.

Figure 2C:
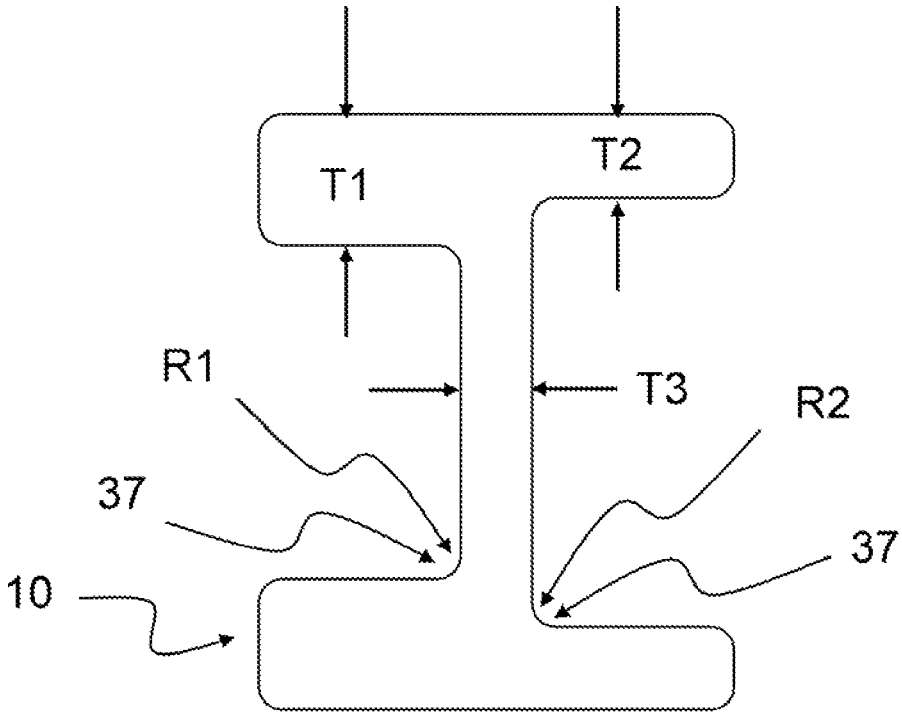
FIG. 2C is a plan view of the fence dropper shown in FIG. 1.
Figure 3:
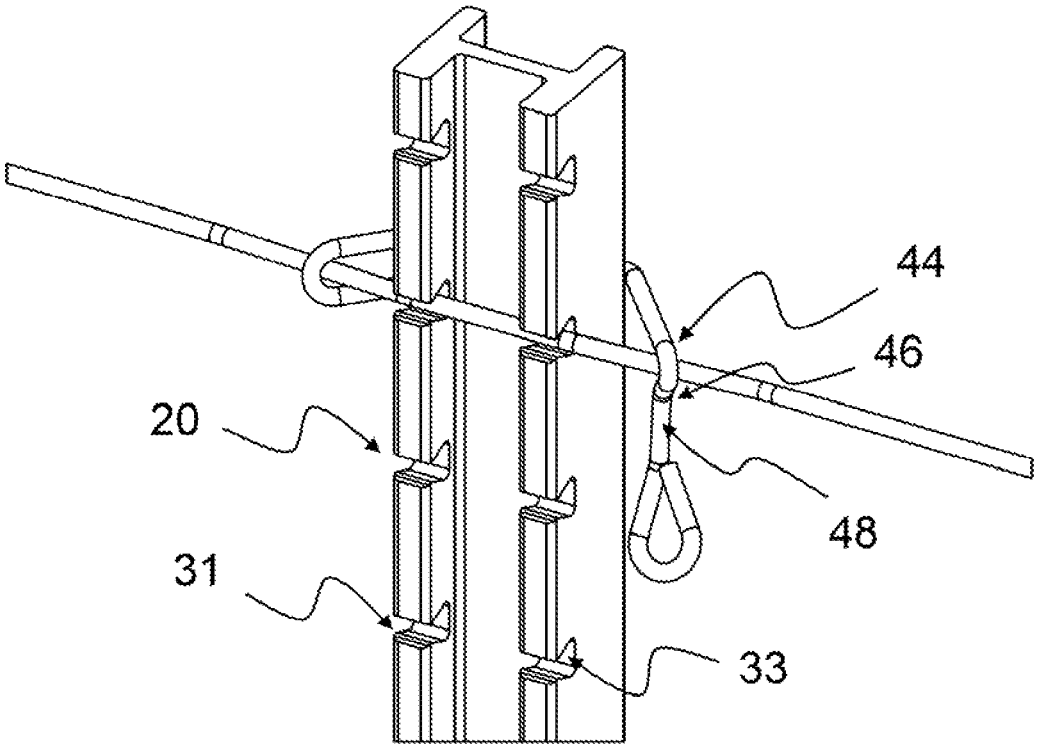
FIG. 3 is a front right perspective view of the fence dropper and fence clip shown in FIG. 1.

With reference to FIG. 2C, at the interfaces between walls 16 and the web 18, the fence dropper 10 comprises a bead 37 to minimise the concentration of stress in the fence dropper when in use. Beads 37 can be of various radii from about 0.5 mm to about 7 mm. The radius R1 on the first side 22 of the web 18 can be the same as or different to the radius R2 on the second side 28 of the web 18.

Figure 7:
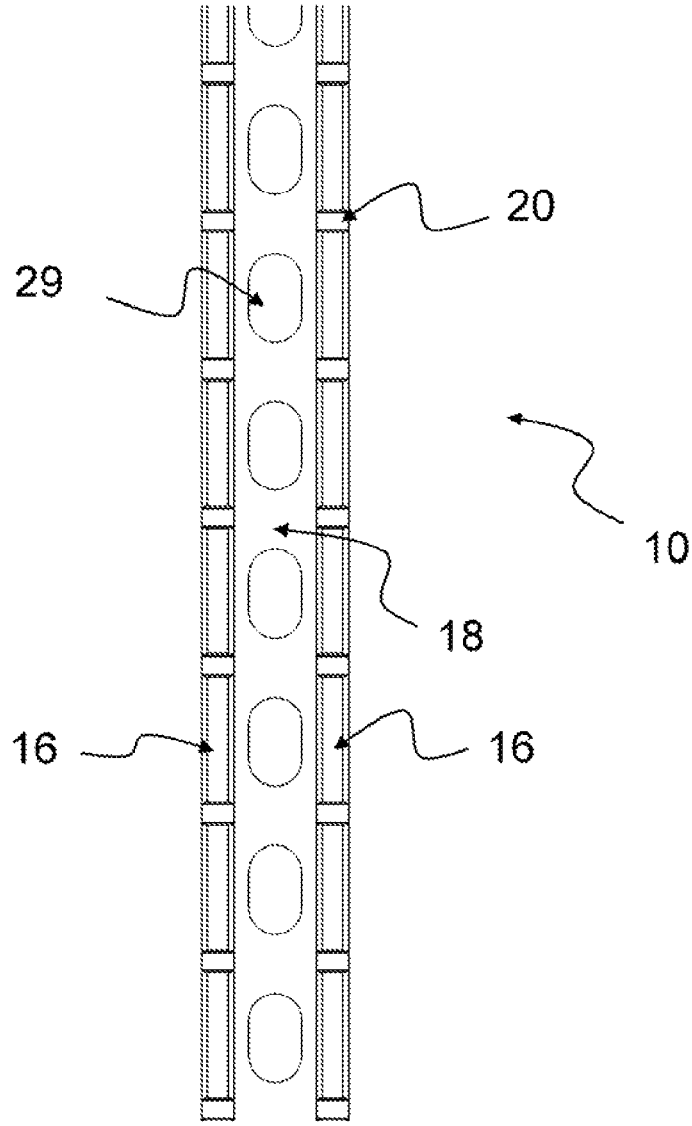
FIG. 7 is a front view of another embodiment of the fence dropper showing apertures in a web of the fence dropper.
Figure 7A:
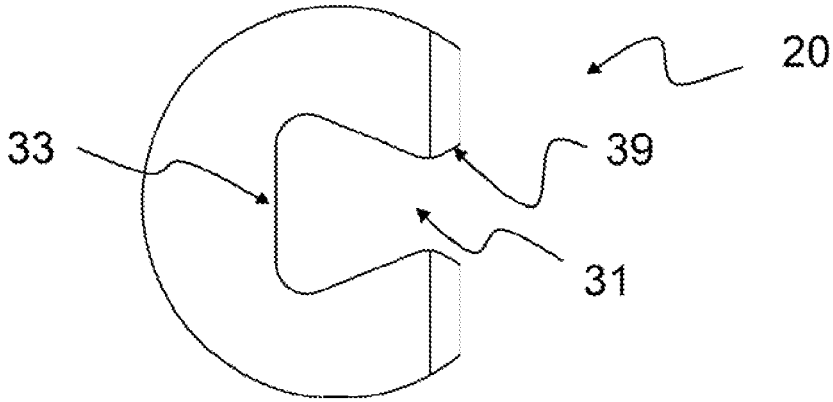
FIG. 7A is close up side view of part of the fence dropper and a slot of the fence dropper.

Referring to FIG. 7A, in preferred embodiments, slots 20 have a shape that can be considered as a dovetail shape, as a wedge shape or as substantially C-shaped. A size of the slot increases from an opening 31 of the slot to a rear wall 33 of the slot. Opening 31 comprises upper and lower lips 39. At least one of the lips 39 and preferably both lips 39 of opening 31 are flared outwardly to assist in locating the fence wire in the slot. In some embodiments, lips 39 of opening 31 are angled at the top and bottom of the opening at about 52° to the horizontal to produce an opening angle of about 104°, but other angles can be employed. Hence, fence wires are easy to locate in slots of this shape and such slots reliably retain the wire 24. Such slots, combined with the H-shaped cross section 14, also enable the fence dropper to have a significantly smaller cross-section than prior art fence droppers, whilst comprising sufficient strength.

With reference to FIG. 7, according to some embodiments, the web 18 comprises one or more apertures 29 therethrough, which reduces the mass of the fence dropper 10 and the amount of material consumed to produce the fence dropper. The reduced mass also renders the fence dropper 10 easier to use and cheaper to transport. Such apertures can also be used to attach a label and/or to tie multiple fence droppers together for transportation. In some embodiments, the apertures 29 are lozenge shaped, as shown in FIG. 7, but other shapes for the apertures can be employed, such as circles, squares, ovals, triangles or irregular shaped apertures if required.

Figure 7B:
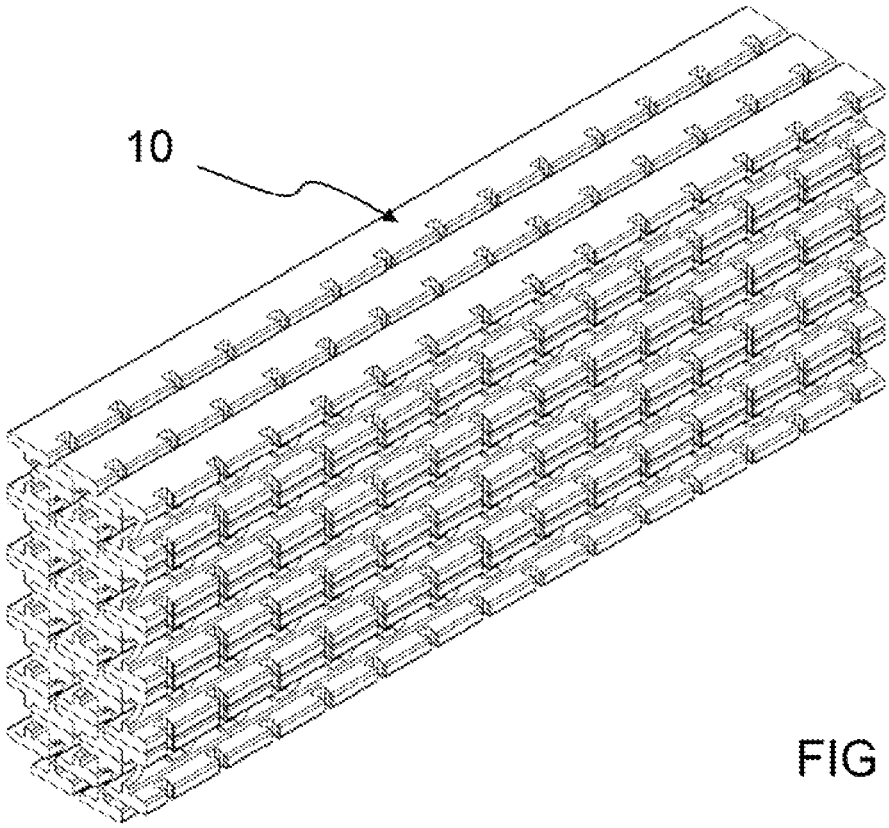
FIG. 7B is a perspective view of a plurality of fence droppers nested together.
Figure 7C:
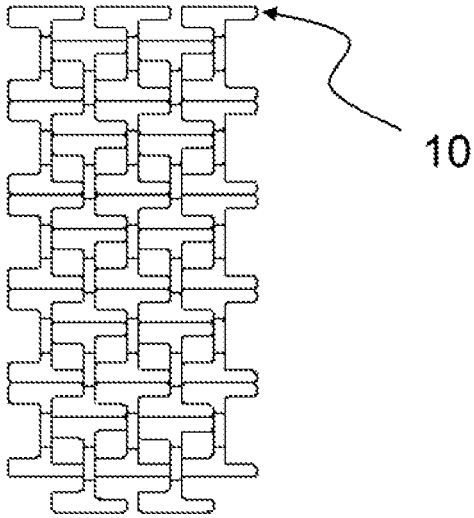
FIG. 7C is an end view of the nested fence droppers shown in FIG. 7B.

Referring to FIGS. 7B and 7C, another feature of the fence droppers 10 according to embodiments of the present invention is that the cross-sectional shape allows the fence droppers to be nested, thus reducing the volume occupied by multiple fence droppers, which is particularly important for transportation purposes. Hence, more fence droppers can be transported per unit volume compared with the prior art, which reduces transportation costs and/or enables more fence droppers to be transported in a single load. FIGS. 7B and 7C show a batch of twenty-five fence droppers 10 comprising a substantially H-shaped cross-section. The fence droppers are nested together by walls 16 of the fence droppers occupying some of the space between opposing walls 16 of adjacent fence droppers to minimise the volume consumed by the bundle of fence droppers.

In the example shown in FIGS. 7B and 7C, the cross sectional area of each dropper is about 227 $mm^2$. 25 droppers nested as shown occupy an approximately rectangular area of about 134 mm×66 mm=8,844 $mm^2$. Hence, the packing efficiency=25×227 $mm^2$/8,844 $mm^2$=64.2%.

The packing efficiency of fence droppers according to the present invention is at least 60%, which is at least twice that of many prior art fence droppers. Table 2 below shows a comparison between a popular prior art fence dropper made from the same material of HDPE and a fence dropper according to embodiments of the present invention:

TABLE 2

| Items | Mass per metre (g/m) | Density of HDPE ($g/cm^3$) | Cross section area ($mm^2$) | Packing Efficiency |
|---|---|---|---|---|
| Prior Art | 312 | 0.95 | 336 | 30.5% |
| H shape cross section | 192 | 0.95 | 227 | 64.2% |
| Percentage H shape/ prior art | 61.5% | 100% | 67.6% | 210.5% |

According to some embodiments, a lower end of the elongate body 12 of the fence dropper 10 is tapered to facilitate insertion of the fence dropper into the ground.

In preferred embodiments, the fence dropper 10 is injection moulded or otherwise formed from plastics material, such as high density poly ethylene (HDPE). HDPE has good impact strength and outdoor life, yet is much lighter and cheaper than other potentially suitable plastics. HDPE also has very good electrical insulating properties and therefore can be used for electrified fences. However, other suitable plastics materials can be used, such as, but not limited to acrylonitrile styrene acrylate (ASA) or poly vinyl chloride (PVC) including an ultraviolet (UV) stabilising additive and therefore the skilled addressee will appreciate the present invention is not limited to the type of material. In some embodiments, the fence dropper 10 can be produced from highly visible plastic to improve the visibility of the fence, for example to animals Embodiments of the fence clip 26 will now be described in detail with additional reference to FIGS. 8-13.

Figure 8:
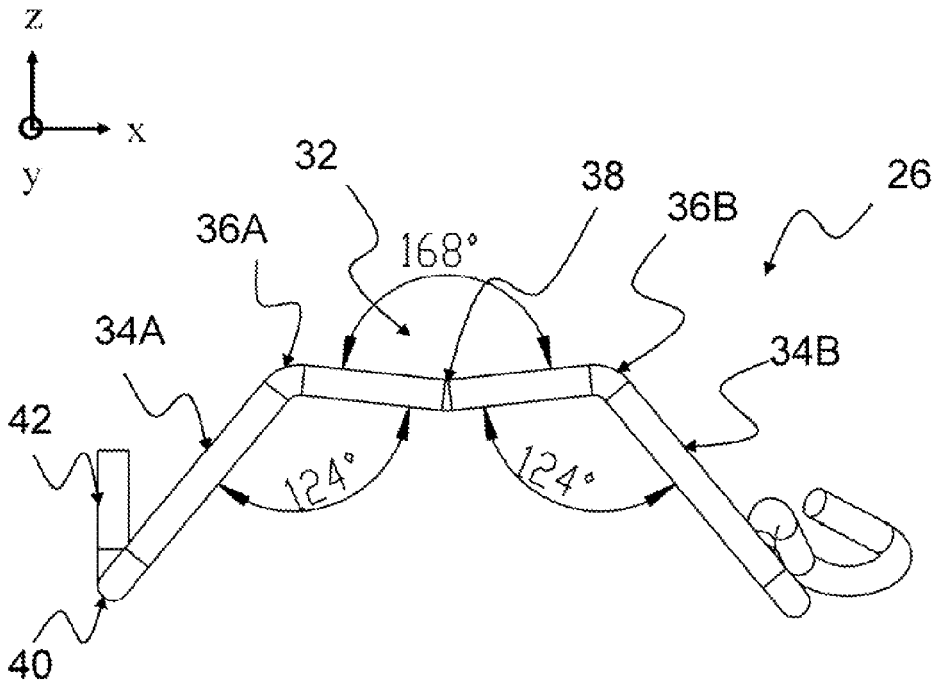
FIG. 8 is a plan view of another embodiment of the fence clip.
Figure 9:
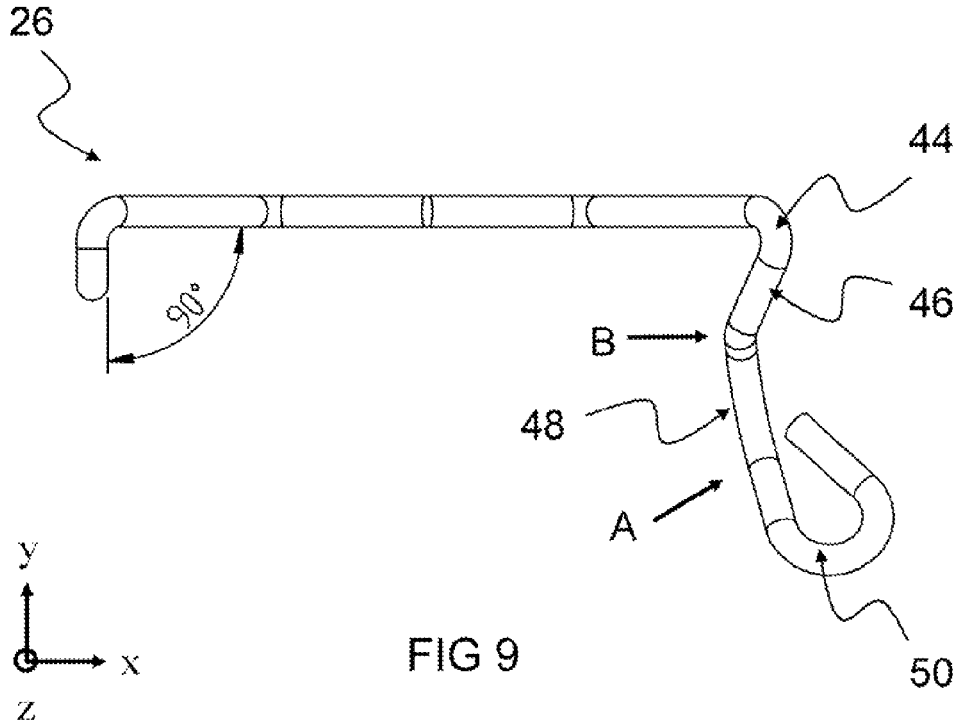
FIG. 9 is a front view of the fence clip shown in FIG. 8.

With reference to FIGS. 8 and 9, the fence clip 26 is formed from an elongate wire bent into an asymmetric shape. The fence clip comprises a central portion 32 along an x-axis of the fence clip 26. Arms 34A, 34B extend respectively from ends 36A, 36B of the central portion and arms 34A, 34B are in the same x-z plane as the central portion 32. Fence clip 26 abuts ends 30 of the walls 16 of the fence dropper at the ends 36A, 36B of the central portion 32 where the wire is bent to form arms 34A, 34B. Arms 34A, 34B are at an angle of between about 100° and about 150° to the adjacent central portion. In the embodiment shown in FIGS. 8 and 9, arms 34A, 34B are at an angle of 124° to the adjacent central portion.

Figure 4:
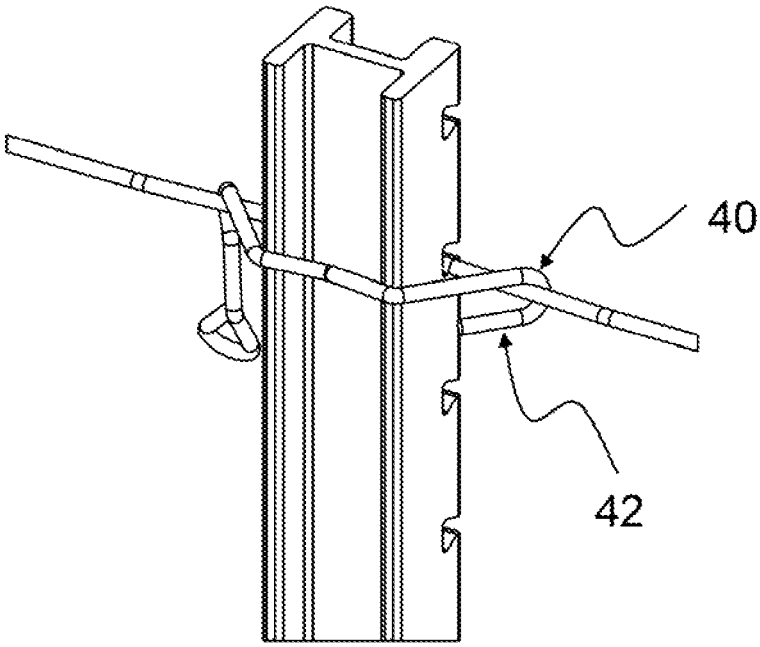
FIG. 4 is a rear left perspective view of the fence dropper and fence clip shown in FIG. 1.
Figure 5:
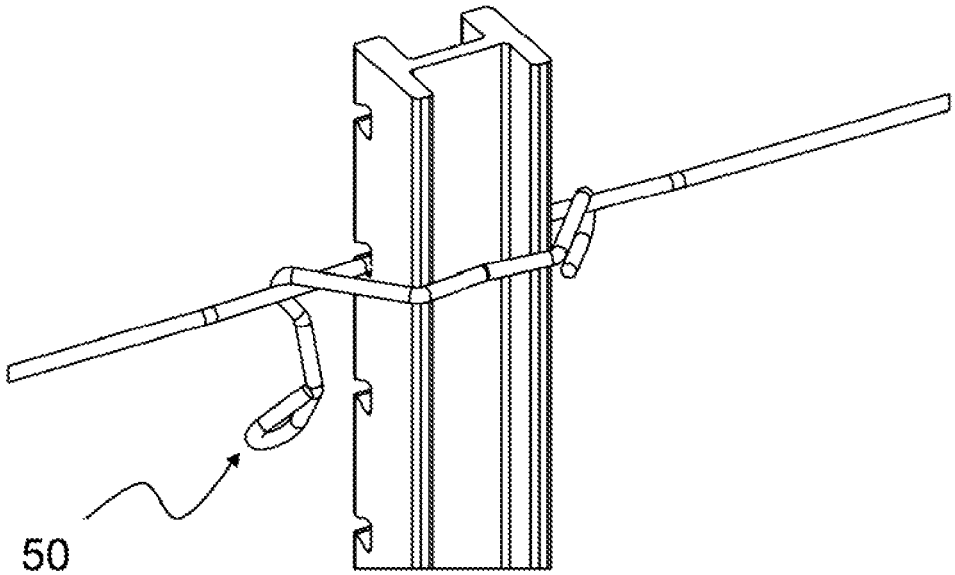
FIG. 5 is a rear right perspective view of the fence dropper and fence clip shown in FIG. 1.

The central portion 32 of the elongate wire is bent inwardly towards the web 18 of the fence dropper 10 about a substantially central point 38 at an angle of between about 160° and less than 180°. In the embodiment shown in FIG. 8, this angle is about 168°. FIGS. 2, 4 and 5 show that at least part of central portion 32 of the fence clip 26 extends into the space between walls 16 on the second side 28 of the web 18. The central portion 32 provides the optimal path for transmitting shocks from the fence wire 24 to the fence dropper 10 in the most efficient manner possible.

Figure 6:
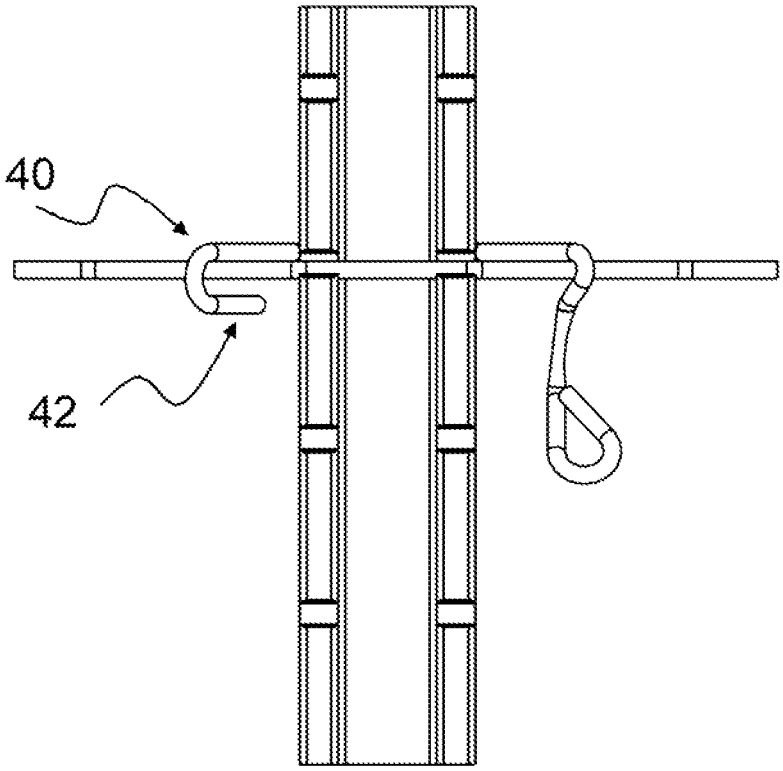
FIG. 6 is a front view of the fence dropper and fence clip shown in FIG. 1

With additional reference to FIGS. 2-6, embodiments of the fence clip 26 also comprise a hook portion extending from an end of each arm 34A, 34B to capture the fence wire 24. With particular reference to FIGS. 4 and 6, a first hook portion 40 comprises a tail 42 which is spaced apart from and substantially parallel to arm 34A. As shown most clearly in FIG. 4, in some embodiments tail 42 is at least about half of the length of the arm 34A to securely capture the fence wire 24. As shown most clearly in FIGS. 2 and 5, in some embodiments first hook portion 40 is in substantially the same plane as arm 34A from which it extends, which simplifies manufacture of the fence clip. FIG. 8 shows an alternative embodiment of the fence clip in which tail 42 is at an angle of about 45° to arm 34A and extends substantially along the z-axis. FIG. 9 shows that hook portion 40 extends substantially perpendicularly to central portion 32 and arms 34A, 34B substantially along the y-axis of the fence clip 26.

With particular reference to FIGS. 8 and 9, a second hook portion 44 extends from arm 34B. Second hook portion 44 captures fence wire 24 on an opposite side of the fence dropper 10 to which the first hook portion 40 captures the fence wire 24. Second hook portion 44 comprises a tail 46, which is shorter than tail 42. Tail 46 is in the same plane as arm 34B and at an angle of between about 30° and about 60° to arm 34B. In the embodiment shown in FIGS. 8 and 9, arm 34B is at an angle of about 55° to arm 34B.

A lever 48 extends from tail 46 of second hook portion 44 at an angle of between about 130° and about 160° to the tail 46. As shown most clearly in FIG. 3, according to some embodiments second hook portion 44, tail 42 and lever 48 are in substantially the same plane as arm 34B from which they extend. According to other embodiments, as shown in FIGS. 8 and 9, lever 48 is at an angle of about 30° to tail 46 in the direction of the positive x-axis.

According to some embodiments, the end of the wire forming the fence clip 26 adjacent lever 48 is formed into a loop at the end of lever 48 such that lever 48 comprises a looped end 50. The looped end 50 is a convenient part by which to hold the fence clip 26, for example between thumb and forefinger, and facilitates the coupling of the fence wire 24 to the fence dropper 10 via the thumb and forefinger of a user in a one-handed operation that does not require any type of tool to install. The looped end 50 distributes pressure across the user's hand, and in particular the user's thumb, thus minimising fatigue to the user's hand and wrist and reducing the likelihood of repetitive strain injury (RSI) as a result of installing a large number of such fence clips.

As shown most clearly in FIGS. 1 and 5, the looped end 50 is in a different plane to the plane of the lever 48. In preferred embodiments, the plane of the looped end 50 is at an angle of between about 100° and about 150° to the plane of the lever 48. In some embodiments, looped end 50 is at an angle of about 105° to lever 48. The angled looped end 50 further increases the length of the fence clip 26 in the positive x-axis and the negative y-axis and further facilitates ease of installation, which is described in further detail hereinafter.

Figure 10:
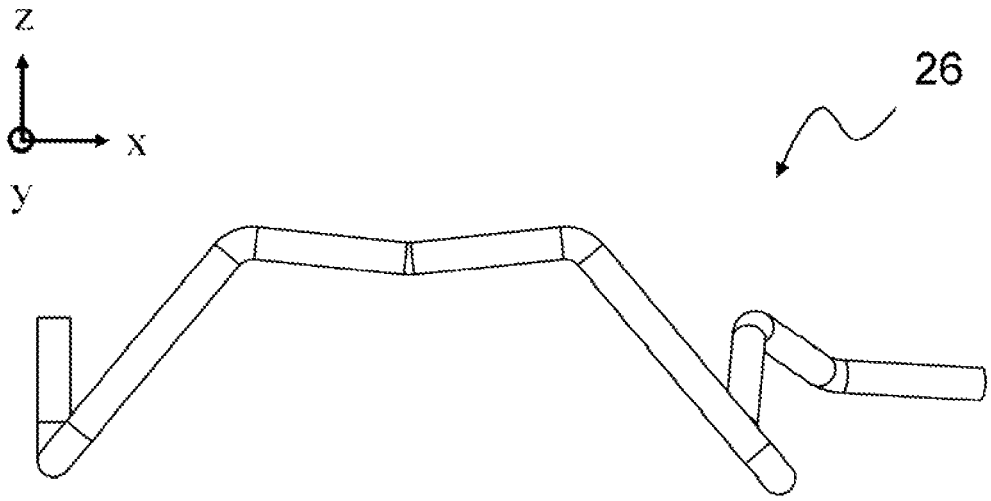
FIG. 10 is a plan view of another embodiment of the fence clip.
Figure 11:
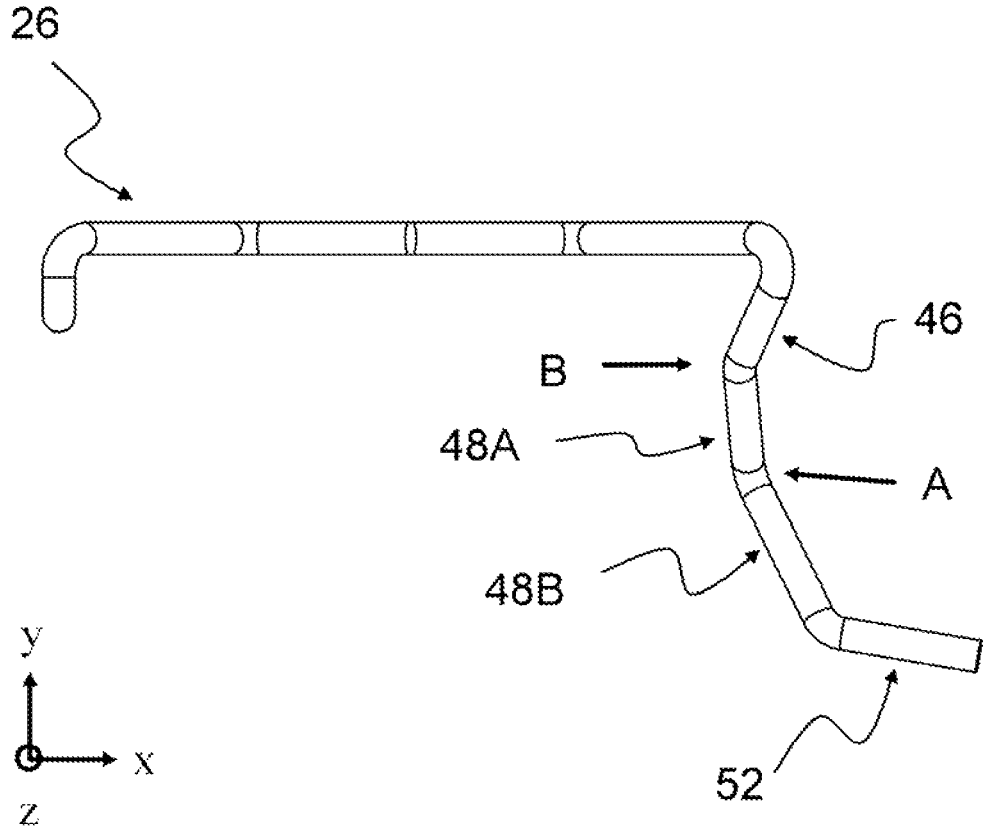
FIG. 11 is a front view of the fence clip shown in FIG. 10.

FIGS. 10 and 11 show another embodiment of the fence clip 26 in which lever 48 comprises two portions 48A, 48B angled with respect to each other. In one embodiment, first lever portion 48A is at an angle of about 150° to tail 46 and second lever portion 48B is at an angle of between about 100° and 130° to first lever portion 48A. In the embodiment shown in FIGS. 10 and 11, second lever portion 48B is at an angle of 116° to first lever portion 48A. In this embodiment, looped end 50 is replaced with a leg 52 extending from second lever portion 48B along the positive x-axis and to a lesser extent along the negative y-axis. Leg 52 is provided at an angle of about 125° to second lever portion 48B. Leg 52 serves the same purpose as looped end 50 in that it increases the surface area of the fence clip in contact with the user's hand rendering the fence clip more ergonomic and more comfortable to use. Lever 48, first and second lever portions 48A, 48B, looped end 50 and leg 52 increase or extend the length of the fence clip in the positive x-axis and the negative y-axis in a direction away from the central portion 32 to provide greater leverage during installation of the fence clip 26.

Figure 12:
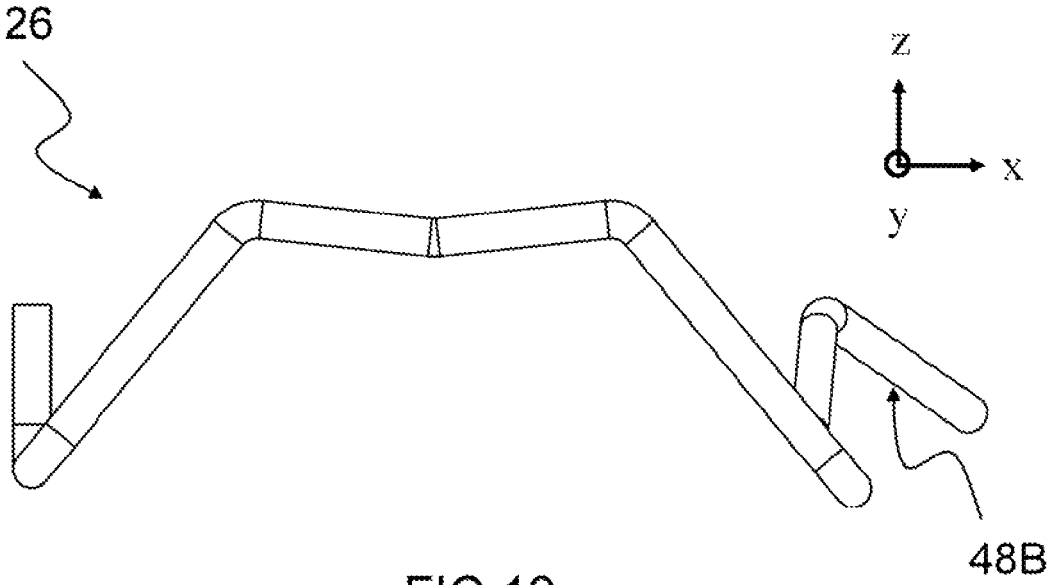
FIG. 12 is a plan view of a further embodiment of the fence clip.
Figure 13:
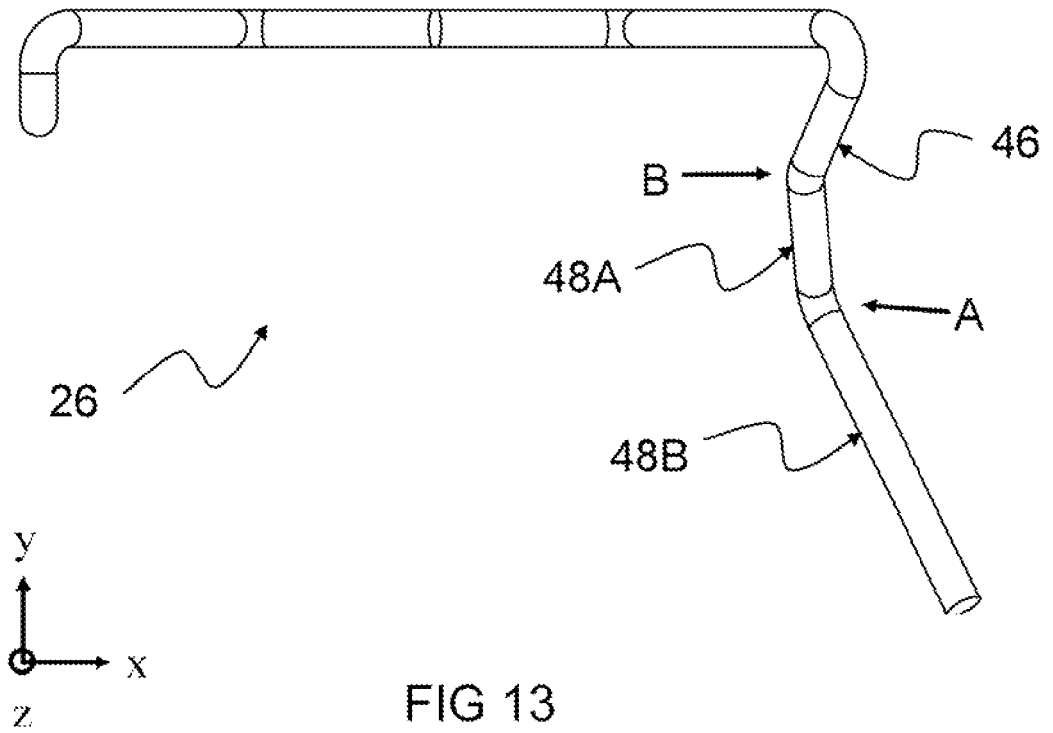
FIG. 13 is a front view of the fence clip shown in FIG. 12.

FIGS. 12 and 13 show a further embodiment of the fence clip 26 in which the looped end 50 and leg 52 are omitted. Lever 48 comprises two portions 48A, 48B angled with respect to each other as described above in relation to the embodiment shown in FIGS. 10 and 11. However, in this embodiment, an extended second lever portion 48B is of increased length compared with the length of the second lever portion 48B in the previous embodiment such that increased surface contact area and increased leverage length are also exhibited in this embodiment. The extended second lever portion 48B also increases or extends the length of the fence clip along the negative y-axis and to a lesser extent along the positive x-axis. In some embodiments, the extended second lever portion 48B is at least 1.5 times the length of the first lever portion 48A.

In the embodiments shown in FIGS. 10-13, the bend point between first lever portion 48A and second lever portion 48B is further from arm 34B than the bend point between tail 44 and first lever portion 48A. This results in more elastic bending at the bend point between first lever portion 48A and second lever portion 48B. Fence clip 26 is therefore easier to apply than prior art fence clips. Furthermore, fence clip 26 is harder to dislodge than many prior art fence clips.

For completeness, installation of the fence dropper 10, fence wire 24 and fence clip 26 will now be described below.

Once the fence dropper 10 has been inserted into the ground, if required, fence wire 24 is captured in a pair of slots 20 through opening 31 in the slots. First hook portion 40 is looped around and captures the fence wire 24. During installation, hook portion 40 remains substantially stationary regarding its position along the fence wire 24 and the fence clip pivots about this position as central portion 32 is moved to the second side 28 of the web 18. Lever 48, first and second lever portions 48A, 48B, looped end 50 and/or leg 52 are moved across the fence wire 24 depending on the embodiment of the fence clip being used. As pressure is applied to the lever 48, first and second lever portions 48A, 48B, looped end 50 and/or leg 52, potential energy in the fence clip increases. As tail 46 passes over the fence wire, the potential energy is released and second hook portion 44 engages the fence wire and locks the fence clip 26 in place with central portion 32 abutting ends 30 of walls 16. Thus, fence clip 26 secures the fence wire 24 in slots 20 of the fence dropper 10 with a minimum of force.

With reference to FIGS. 9, 11 and 13, points A and B are bending points and maximum loading points for the fence clip 26. In the embodiment in FIG. 9, points A and B are bending points between looped end 50 and lever 48 and between lever 48 and tail 46 respectively. In the embodiments in FIGS. 11 and 13, points A and B are bending points between first and second lever portions 48A, 48B and between first lever portion 48A and tail 46 respectively. Point A is further along the negative y-axis and therefore the fence clip is more elastic about point A compared with prior art fence clips, which helps reduce the force required for installation, i.e. the location of the bending point A between the first lever portion and the second lever portion aids reduction in a force required to install the fence clip. The angle between arm 34B and tail 46 is more acute that prior art fence clips thus providing a better locking angle thus rendering the fence clip more difficult to dislodge. Point A is further along the positive z-axis, which also makes the fence clip 26 more difficult to dislodge from the fence wire 24. The difficulty of dislodging the fence clip 26 is further contributed to by the asymmetric shape of the fence clip 26.

In some embodiments, the fence clip 26 is made from high tensile steel spring wire having a circular cross-section of diameter about 2.5 mm. However, normal steel wire can be used and the wire can be of alternative diameters. In some embodiments, the steel wire can be stainless steel and can be galvanised or passivated. The steel wire has a tensile strength of about 400 MPa to about 2100 MPa and in preferred embodiments the tensile strength is about 700 MPa to about 1200 MPa.

Hence, according to a further aspect, embodiments of the invention reside in a fencing system comprising the fence dropper 10 and the fence clip 26 which couples the fence wire 24 to the fence dropper 10, optionally in a one-handed operation. As described above, the fence dropper 10 comprises elongate body 12 having the pair of spaced apart walls 16 coupled by the web 18. At least one slot 20 is provided in each of the walls 16 on a first side 22 of the web 18 for capturing the fence wire 24. The fence dropper comprises the substantially H-shaped cross-section 14, the A-shaped cross section or a cross section with walls 16 and/or web 18 at intermediate angles wherein a ratio of a slot breaking mass to a cross sectional area of the fence dropper is substantially optimised. The fence clip 26 of the fencing system comprises the elongate wire bent into an asymmetric shape. The central portion 32 of the fence clip abuts the second side 28 of the fence dropper and arms 34A and 34B extend from each end of the central portion. First and second hook portions 40, 44 extend from respective ends of the arms to capture the fence wire 24. At least one lever or lever portion extending from one of the hook portions in a direction away from the central portion 32 extends the length of the fence clip 26 at least along the positive x-axis. In some embodiments, lever 48 extending from second hook portion 44 and looped end 50 facilitates the one-handed operation of locking the fence clip 26 in place. In other embodiments, the same functionality is provided by first lever portion 48A, second lever portion 48B and leg 52 or by first lever portion 48A and extended second lever portion 48B.

Hence, the fence droppers 10, fence clips 26 and fencing systems described herein address at least some of the aforementioned problems of the prior art fencing systems.

The H-shaped cross-section 14, the A-shaped cross section or a cross section with walls 16 and/or web 18 at intermediate angles of the fence dropper 10 wherein a ratio of a slot breaking mass to a cross sectional area of the fence dropper is substantially optimised reduces the amount of material consumed, thus reducing the mass of the fence dropper, the cost of production and the cost of transportation whilst rendering the fence dropper easier to use. The apertures 29 in the web 18 further reduce the mass of the fence dropper. The H-shaped or A-shaped cross-section or cross section having intermediate angles of the fence dropper 10 provides superior rigidity and strength compared with many of the prior art fence droppers such that the dimensions of the cross-section of the fence dropper can be reduced, further reducing material consumption and costs. The cross-section also allows the fence droppers 10 to be nested, thus reducing the volume occupied by multiple fence droppers, which is particularly important for transportation purposes. Alternatively, more fence droppers according to the present invention can be transported per unit volume compared with the prior art. The packing efficiency of fence droppers according to the present invention is at least 60%, which is at least twice that of many prior art fence droppers.

Manufacturing the fence dropper from HDPE results in lightweight, high tensile strength fence droppers at relatively low cost, which have a good outdoor life. Fence droppers according to the present invention can withstand a fence wire pull out force of at least 600N and have a life of at least 5 years in an Australian rural environment. However, other plastics materials, such as ASA or PVC including a UV stabilising additive, can be used.

Unlike some of the prior art fence droppers, no additional support is required for the fence droppers according to embodiments of the present invention. The fence droppers according to the present invention can be used for both electrified and non-electrified fences. For electrified fences, fence droppers according to the present invention can withstand at least 16 kV without arcing.

The dovetail, wedge-shaped or C-shaped slots 20 of the fence dropper 10 comprising the flared opening 31 allow the easy location of the fence wires 24 whilst retaining the fence wires therein. Even without the fence clip 26 in place, an axial load of at least 110 kg can be applied before slot 20 shears off, which is a far superior load to many prior art fence droppers.

Fence clips 26 secure the fence wires to the fence dropper 10 in an easy, single-handed operation without the need of any tool, either a common tool or a specialist tool, at least in part because the fence clip 26 does not need to be deformed to an appreciable extent to attach the fence clip to the fence dropper. Hence, a lower installation force is required, thus reducing the likelihood of RSI. The ease of installation is contributed to by the asymmetric shape of the fence clips 26 comprising the looped end 50, or first lever portion 48A, second lever portion 48B and leg 52 or comprising first lever portion 48A and extended second lever portion 48B. Fence clips 26 also require a greater force to dislodge than prior art fence clips. Overall, the inventors estimate that the fence clips of the present invention are more than four times more efficient that some of the prior art fence clips. Furthermore, the fencing system is also easy to maintain, safe to use and is environmentally friendly.

Throughout the specification the aim has been to describe the preferred embodiments of the invention without limiting the invention to any one embodiment or specific collection of features. It is to be appreciated by those of skill in the art that various modifications and changes can be made in the particular embodiments exemplified without departing from the scope of the present invention.

The invention claimed is:

1. A fence system comprising:

a fence dropper, comprising:

opposing left and right side walls, each side wall defining a substantially flat, elongate member and comprising opposing front and rear outer edges, wherein the respective front outer edges of the side walls each comprise at least one slot; and a web connecting the left and right side walls, the web connected to each side wall at a point between the respective front and rear outer edges of each side wall; and wherein:

a thickness of the sidewalls on a front side of the web is greater than the thickness of the side walls on an opposing, rear side of the web;

at least one wire, engaged within the at least one slot of each of the front outer edges of the side walls; and a fence clip, comprising:

an elongate central portion extending between opposing left and right ends, wherein the left and right ends engage with the rear outer edges of the left and right sidewalls, respectively, and wherein a bend is formed at a central point of the central portion, the bend extending towards the web between the arms;

left and right arms extending from the left and right ends of the central portion, respectively, the arms extending towards the front outer edges of the left and right side walls;

left and right hook portions extending from the left and right arms, respectively, and bending around the wire toward the web so as to maintain the wire within the slots; and wherein at least one of the left and right hook portions further comprises a lever portion extending away from the central portion and towards the front outer edges, the lever portion configured to be grasped by a user to manipulate the fence clip.

2. The fence system of claim 1, wherein a cross section of the fence dropper is substantially uppercase-H-shaped.

3. The fence system of claim 1, wherein the spaced apart walls are substantially parallel and the web is substantially perpendicular to the walls.

4. The fence system of claim 1, wherein the walls are angled with respect to each other at an angle of greater than 0° and up to about 60° and/or the web is at an angle of greater than 90° and up to about 120° with respect to one or both of the walls.

5. The fence system of claim 1, wherein the rear outer edges are rounded where contact is made with the fence clip.

6. The fence system of claim 1, wherein a shape of the slots is selected from one of the following: wedge shaped; substantially C-shaped.

7. The fence system of claim 1, wherein a size of the slot increases from an opening of the slot to a rear wall of the slot.

8. The fence system of claim 7, wherein at least one lip of the opening is flared outwardly.

9. The fence system of claim 1, wherein the front outer edges of each wall comprise a plurality of spaced apart slots along a length of the fence dropper.

10. The fence system of claim 9, wherein at least some of the slots have one or more of the following characteristics: are equally spaced along the length of the elongate body; are horizontally aligned with a respective slot in the other wall.

11. The fence system of claim 9, wherein at least some of the slots are unequally spaced along the length of the elongate body.

12. The fence system of claim 1, wherein the web comprises one or more apertures therethrough.

13. The fence system of claim 1, wherein the fence dropper is moulded or otherwise formed from one of the following plastics materials: high density poly ethylene; acrylonitrile styrene acrylate; poly vinyl chloride including an ultraviolet stabilising additive.

14. The fence system of claim 1, further comprising at least one bead at an interface between one of the walls and the web to minimise stress concentration.

15. The fence system of claim 14, wherein a radius of the bead on the first side of the web is the same as the radius of the bead on the second side of the web.

16. The fence system of claim 14, wherein a radius of the bead on the first side of the web is different to the radius of the bead on the second side of the web.

17. The fence system of claim 1, wherein a cross-sectional shape of the fence dropper enables the opposing walls of the fence dropper to occupy space between the opposing walls of adjacent fence droppers during transportation.

18. The fence system of claim 1, wherein thicknesses of:

a) the web;

b) the portion of each wall on the first side of the web; and c) the portion of each wall on the second side of the web are selected such that a ratio of a mass required to break the slot to a cross sectional area of the fence dropper is maximised.

19. The fence system of claim 1, wherein the arms are in the same plane as the central portion.

20. The fence system of claim 1, wherein the arms are at an angle of between about 100° and about 150° to the adjacent central portion.

21. The fence system of claim 1, wherein at least one of the hook portions is in the same plane as the arm from which the hook portion extends.

22. The fence system of claim 1, wherein the at least one lever or lever portion is in the same plane as the hook portion from which the lever or lever portion extends.

23. The fence system of claim 22, wherein the looped end is designed to be held between a thumb and a forefinger and distribute pressure across a user's hand during installation of the clip.

24. The fence system of claim 22, wherein one or more of the looped end, first lever portion, second lever portion and/or leg extend along a negative y-axis.

25. The fence system of claim 1, wherein the lever or lever portion comprises a looped end.

26. The fence system of claim 25, wherein the looped end is in a different plane to a plane of the lever or lever portion, such that the plane of the looped end is at an angle of between about 30° and about 60° to the plane of the lever or lever portion.

27. The fence clip system of claim 1, comprising a first lever portion extending from one of the hook portions and a second lever portion extending from the first lever portion at an angle to the first lever portion.

28. The fence system of claim 27, wherein the fence clip comprises a leg extending from the second lever portion.

29. The fence system of claim 27, wherein a bending point is located between the first lever portion and the second lever portion to reduce a force required to install the fence clip.

30. The fence system of claim 1, wherein the fence clip is made from one of the following: steel wire; stainless steel wire; high tensile spring steel wire; galvanised steel wire; passivated steel wire; wherein the tensile strength of the fence clip is between 400 Mpa and 2100 Mpa.

* * * * *